United States Patent [19]

Hockema

[11] 4,292,903

[45] Oct. 6, 1981

[54] ADJUSTABLE BOX STOOL

[76] Inventor: Robert J. Hockema, 1200 Ridgeway, Lafayette, Ind. 47904

[21] Appl. No.: 90,580

[22] Filed: Nov. 2, 1979

[51] Int. Cl.[3] ..... A47B 9/12; A47B 9/14; A47B 9/20

[52] U.S. Cl. ..... 108/146; 248/423; 297/462; 312/312

[58] Field of Search ..... 108/146, 144; 312/312; 248/423, 188.2, 188.5; 297/462

[56] References Cited

U.S. PATENT DOCUMENTS

| | | | |
|---|---|---|---|
| 520,702 | 5/1894 | Palmberg | 108/144 X |
| 872,498 | 12/1907 | Cleveland | 108/146 |
| 1,020,902 | 3/1912 | Hall | 108/146 |
| 1,058,300 | 4/1913 | Hall | 108/146 X |
| 2,649,137 | 8/1953 | Roberts | 108/146 |
| 2,770,293 | 11/1956 | Eichorst | 297/462 X |
| 3,217,672 | 11/1965 | Haughey | 108/146 |

*Primary Examiner*—James T. McCall

[57] ABSTRACT

This stool is adaptable for many uses, and it includes a hollow outer box, in which is slidably received an inner box, that is elevatable in height by linkage arms and a liftwire. The arrangement also includes a pair of pins for being positioned in openings of the outer box, so as to render the inner box secure at any desired height.

1 Claim, 2 Drawing Figures

ADJUSTABLE BOX STOOL

Figures 1, 2:
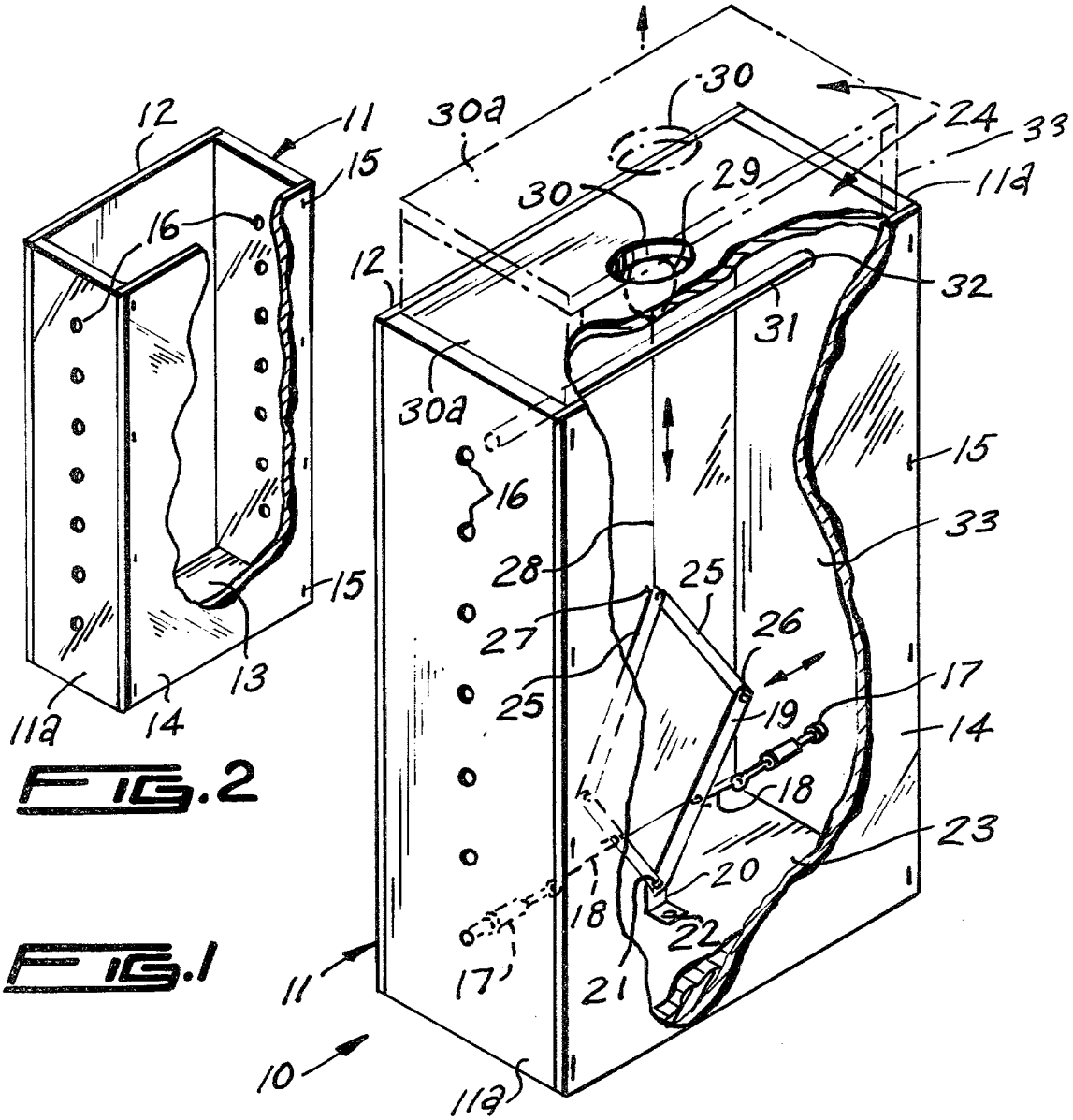

This invention relates to seats, and more particularly, to an adjustable box stool.

It is, therefore, the principal object of this invention to provide an adjustable box stool, which may be used for many purposes in a residence or shop.

Another object of this invention is to provide an adjustable box stool, which may be used when placed on any of three of its sides.

A further object of this invention is to provide an adjustable box stool, which will employ the use of a mechanical linkage with pin means to raise and lower an inner box member of the assembly.

Other objects are to provide an adjustable box stool, which is simple in design, inexpensive to manufacture, rugged in construction, easy to use, and efficient in operation.

These, and other objects, will be readily evident, upon a study of the following specification, and the accompanying drawing, wherein:

FIG. 1 is a perspective view of the present invention, shown partly broken away, with the inner box member shown raised partially, in phantom lines, and FIG. 2 is a fragmentary perspective view of the outside box member, shown reduced in scale.

According to this invention, a box stool 10 is shown to include a hollow outer box 11, having side walls 11*a*, a back wall 12, a bottom wall 13, and a front wall 14, all of which are secured together by suitable fasteners 15. A plurality of equally spaced-apart openings 16, through side walls 11*a*, provide a means for removably receiving clevis pin latches 17, so as to adjust box stool 10 in height, at two inch intervals, which hereinafter will be described.

The mechanism for adjusting box stool 10 includes a wire 18 secured to each clevis pin latch 17 at one end, and is secured, at its opposite end, to a link rod 19 at the center, and the link rods 19 are a pair, that are secured to each other at one end, to bracket 20 by means of fastener 21, and bracket 20 is secured to bottom wall 23 of inner box 24.

A pair of link rods 25 are secured, at one end, to link rods 19, by means of fasteners 26, and their opposite ends are secured together by the hook 27 end of stainless steel wire 28. Wire 28 is terminated at its opposite end by a pull-ring 29, access to which is by opening 30 in the top wall 30*a* of inner box 24. A horizontal dowel

31 is secured fixedly in openings 32 of the side walls 33 of inner box 24, and the wire 28 is freely and transversly received through dowel 31, thus providing support means for wire 28.

In use, pull-ring 29 is grasped by the user, and lifted, to remove the clevis pin latches 17 from the openings 16 in side walls 11*a*, so as to raise or lower, inner box 24 to another height, and when pull-ring 29 is released, the link arms 18 and 25 will reposition clevis pin latches 17 in the proper openings 16, whereupon the user may seat himself on the top wall 30*a* of inner box 24.

As shown in FIG. 1, the two link rods 19 and the two link rods 25 together form a four-sided frame, and the fasteners 21 and 26, as well as hook 27 means, provide flexible connection means between all the link rods, so that clevis pin latches may be pulled toward each other in order to be withdrawn from openings 16 on opposite sides of the outer box, when the wire 28 pulls the hook 27, so that the frame connected at one corner to the stationary bracket 20, is thus stretched vertically, and narrowed horizontally.

While various changes may be made in the detail construction, it is understood that such changes will be within the spirit and scope of the present invention, as is defined by the appended claims.

What I now claim is:

1. An adjustable box stool, comprising, in combination, an outer hollow box, an inner hollow box vertically slidable in said outer box, a vertical row of spaced-apart openings on opposite sides of said outer box, a horizontally slidable clevis pin latch in each opposite side wall of said inner box being outwardly slidable into selective of said openings in said outer box, for securement of said boxes together; each said clevis pin latch being connected by a first wire to a longitudinally intermediate portion of a first pair of link rods which at one ends are attached to a bracket mounted on a bottom of said inner box; a second pair of link rods attached at their one ends to opposite ends of said first link rods, and opposite end of each said second pair of link rods being hooked together to one end of a singular, upwardly second wire extending slidably through a transverse hole in a horizontal dowel secured between said side walls of said inner box, and an upper opposite end of said second wire being fitted with a pull ring; and an access hole in a top wall of said inner box for a person's hand to reach therein and pull said pull ring.

* * * * *